US006250717B1

(12) United States Patent
Porcheron

(10) Patent No.: US 6,250,717 B1
(45) Date of Patent: Jun. 26, 2001

(54) HINGE BLOCK FOR THE ARM-REST OF A WHEELCHAIR FOR THE HANDICAPPED, AND A CORRESPONDING WHEELCHAIR

(75) Inventor: François Porcheron, Lyons (FR)

(73) Assignee: I.D.C. Medical, Beynost (FR)

( * ) Notice: Subject to any disclaimer, the term of this patent is extended or adjusted under 35 U.S.C. 154(b) by 0 days.

(21) Appl. No.: 09/338,498

(22) Filed: Jun. 23, 1999

(30) Foreign Application Priority Data

Jun. 23, 1998 (FR) ..... 98 08107

(51) Int. Cl.[7] ..... A47C 7/54

(52) U.S. Cl. ..... 297/411.3; 297/411.35; 297/411.38; 297/DIG. 4; 297/DIG. 10; 297/464; 297/487; 297/488

(58) Field of Search ..... 297/411.37, 411.35, 297/411.38, DIG. 10, DIG. 4, 464, 487, 488

(56) References Cited

U.S. PATENT DOCUMENTS 4,065,179 * 12/1977 Takasaki ..... 297/464
4,076,304 * 2/1978 Deucher ..... 297/DIG. 10 X
4,120,530 * 10/1978 Imbro ..... 297/DIG. 10 X
4,141,094 * 2/1979 Ferguson et al. ..... 297/DIG. 10 X
4,568,122 * 2/1986 Kain ..... 297/488
4,579,191 * 4/1986 Klee et al. ..... 297/488 X
4,623,194 * 11/1986 Pillot ..... 297/DIG. 10 X
4,813,746 * 3/1989 Mulholland ..... 297/464 X
4,846,527 * 7/1989 Julien et al. ..... 297/487 X
5,108,202 * 4/1992 Smith ..... 297/DIG. 10 X
5,368,362 * 11/1994 Ramon et al. ..... 297/464 X
5,447,356 * 9/1995 Snijders ..... 297/464 X
5,556,121 * 9/1996 Pillot ..... 297/DIG. 10 X

FOREIGN PATENT DOCUMENTS 2545718 11/1984 (FR) .

* cited by examiner

*Primary Examiner*—Peter M. Cuomo
*Assistant Examiner*—Rodney B. White
(74) *Attorney, Agent, or Firm*—Dennison, Scheiner, Schultz & Wakeman

(57) ABSTRACT

A wheelchair for the handicapped is provided having an arm-rest hinge block including a back half-block fastened to an upright back of a structure and carrying a pivot pin. An arm-rest half-block mounted to pivot on the pivot pin includes a bore that rotatably receives a cylindrical shank of an angled arm-rest so that the shank is locked in position when the angled arm-rest occupies a substantially horizontal plane or a substantially vertical plane.

12 Claims, 4 Drawing Sheets

FIG.3
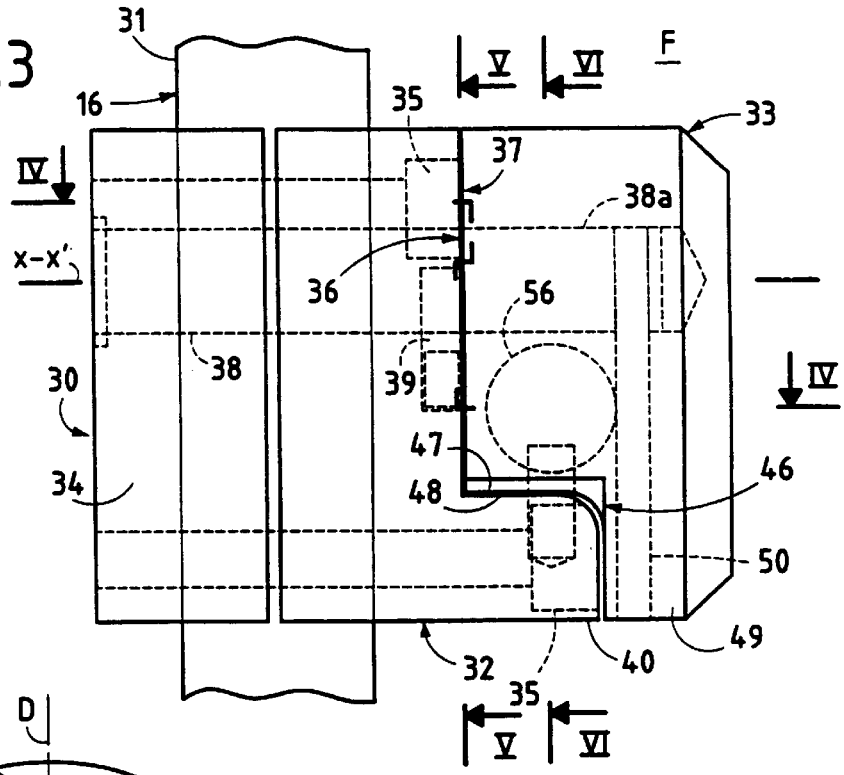
FIG.5
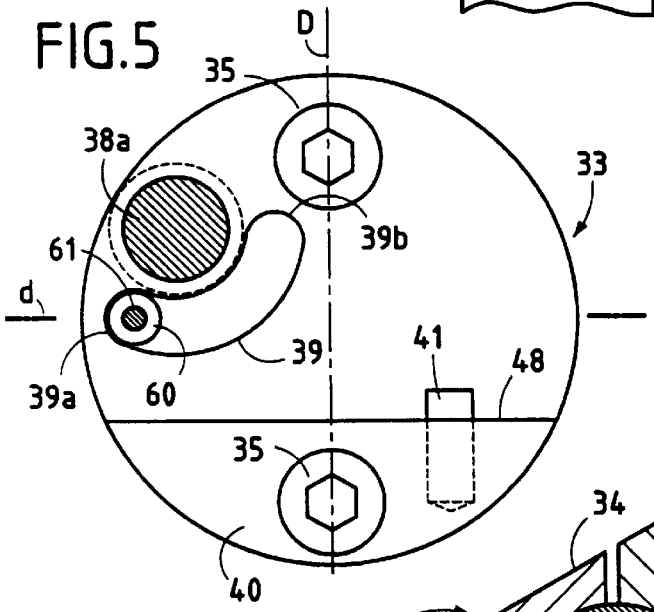
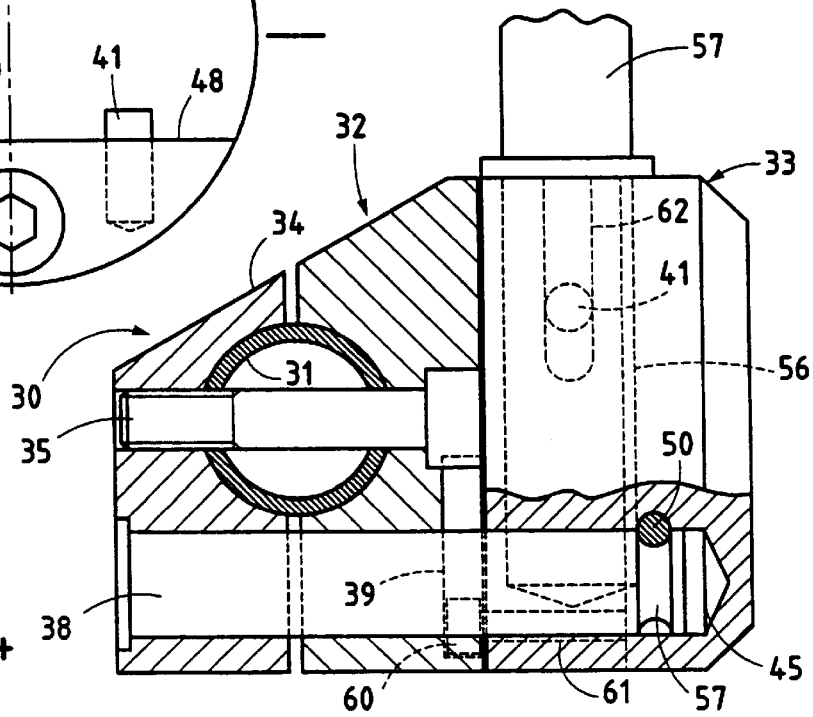
FIG.4

HINGE BLOCK FOR THE ARM-REST OF A WHEELCHAIR FOR THE HANDICAPPED, AND A CORRESPONDING WHEELCHAIR

The present invention relates to wheelchairs used by the handicapped and by invalids, and it is equally applicable to all wheelchairs, whether folding or otherwise.

More particularly, the invention relates to wheelchairs of the kind that include an articulated structure including a back, a seat, and a foot-rest, and associated with drive means enabling the articulated structure to be raised or lowered relative to a frame carrying it, either with or without help from the subject on the wheelchair.

BACKGROUND OF THE INVENTION

Wheelchairs of the above kind undoubtedly represent real progress in that they not only provide mobility, which is essential, but also they enable the subject to take up a standing position which is also important to avoid the physical damage that stems from remaining for a long time in the sitting position.

The prior art proposes various solutions for making wheelchairs of the above type. Those various proposals have advantages and drawbacks, but in general they enable a subject to take up a standing posture, at least to some extent.

Nevertheless, it has been observed that such wheelchairs are unsuitable for use by handicapped or invalid subjects who no longer possess sufficient muscle control to maintain a stable position on the plane supporting them in the standing posture and constituted by the raised articulated structure of a wheelchair.

That is why proposals have been made, in particular in French patent 83/08021 (2 545 718) to adapt such wheelchairs by providing them with body-holding devices. One such device comprises a set of means designed to constitute leg pieces engaging the fronts of the subject's legs, and a second set of means constituted by arm-rests capable of being oriented in generally vertical planes in which they form side guards for the body of a sitting subject, and also in a generally horizontal plane in which they constitute respective halves of a chest-retainer for the subject.

Such a device is suitable for enabling the body to be held properly and it can be installed or adapted in a manner that is found to be acceptable.

The means implemented for changing the orientation of the arm-rests need to take account of the requirement for positive locking in each of the two orientations while making it possible to control pivoting from one orientation to the other and back again without requiring significant physical effort.

In the presently known solution, such means make use of a succession of parts and hinge axes that include catches and notches for locking and holding purposes and that are certainly suitable for satisfying the requirements laid down.

However, it has been observed that under certain circumstances that assembly of hinged parts can lead to the fingers being pinched or indeed to clothes being torn or damaged, without forgetting the major risk of breaking or cutting an electrical feed cable extending between a control and, for example, a system for providing electrical assistance in moving to an upright position.

It has therefore been found necessary to propose improvements to the means for hinging the arm-rests and for locking them positively in either of the two orientations, so as to make them suitable for overcoming the above drawbacks.

OBJECTS AND SUMMARY OF THE INVENTION

It is specifically the object of the invention to propose such improvements seeking essentially to simplify the movements that need to be performed on passing from one orientation to the other and back again, and above all using technical means which are entirely hidden or masked from the outside surfaces so as to avoid risks of pinching, damaging clothes, or undesirable breaking of electrical cables.

To achieve the above objects, the improvements provided relate to a novel hinge block for angled arm-rests for wheelchairs for the handicapped including an articulated "stand-up" structure, with such a hinge block comprising:

- a back half-block fitted to an upright of the back of the structure and carrying a substantially horizontal pivot axis;
- an arm-rest half-block mounted to pivot on the pivot axis from a stable angular position and defining a substantially horizontal bore orthogonal to the pivot axis, and rotatably receiving the cylindrical shank of an angled arm-rest; and
- means interposed between the two half-blocks to ensure:
  - that the shank is locked when the angled arm-rest is occupying either a plane that is substantially vertical or a plane that is substantially horizontal; and
  - that partial pivoting of the arm-rest half-block about the pivot axis enables said means to be unlocked to allow the arm-rest shank to rotate and enables it to be locked angularly after it has rotated.

The invention also provides a wheelchair for the handicapped including a stand-up structure in which at least one of the uprights of the back is provided with at least one arm-rest linked to said upright via a hinge block of the invention.

BRIEF DESCRIPTION OF THE DRAWINGS

Various other characteristics appear in the following description given with reference to the accompanying drawings which show, as non-limiting examples, embodiments and implementations of the invention.

FIG. 3 is a view on a larger scale and as seen from behind looking along arrow III in FIG. 1, showing the means of the invention.

FIGS. 4 and 5 are sections on broken lines IV—IV and V—V of FIG. 3.

MORE DETAILED DESCRIPTION

Figure 1:
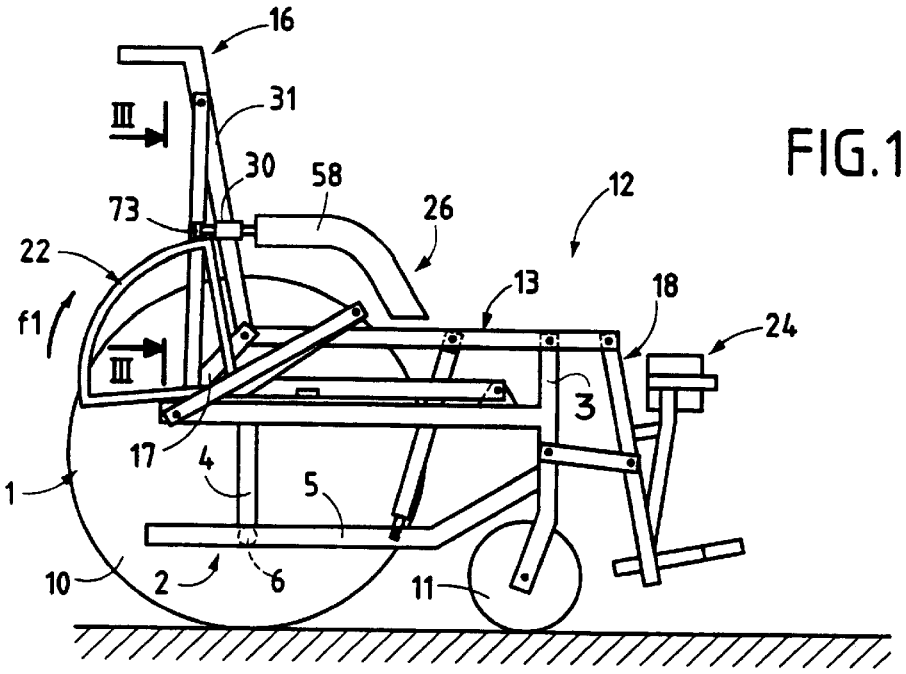
FIGS. 1 and 2 are diagrammatic views of a wheelchair for the handicapped including articulated stand-up structure shown in two particular in-use states.
Figure 2:
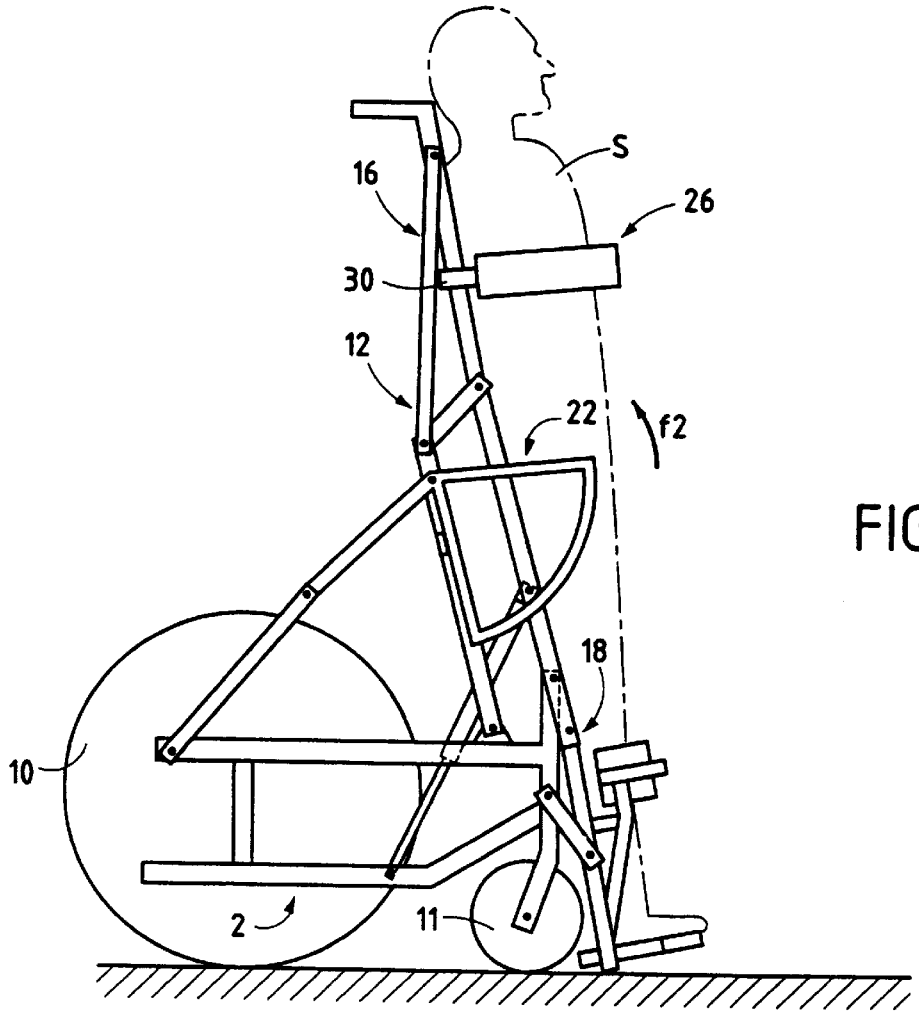

FIGS. 1 and 2 are diagrams showing a wheelchair 1 comprising a chassis 2 constituted by front uprights 3 and back uprights 4 interconnected by longitudinally-extending members 5 and by cross-members such as 6. The chassis 2 is provided with load-carrying and drive wheels 10 and with swiveling wheels 11.

The chassis 2 is fitted with an articulated stand-up structure 12 designed to enable a subject S to be put into a standing posture. To this end, the structure 12 comprises a seat 13 mounted in hinged manner on the chassis via conventional deformable quadrilaterals, a back 16 connected to the rear portion of the seat via a triangular link or the like 17, and a foot-rest 18 connected to the front portion of the chassis 2 via a system comprising two deformable quadrilaterals or the like that are likewise conventional.

The structure 12 is connected to the chassis 2 via two drive assemblies 22 which, when actuated in the direction of arrow $f_1$ starting from the position shown in FIG. 1, serve to raise the articulated structure 12 into the standing-up position shown in FIG. 2, in which position action in the direction of arrow $f_2$ on the assemblies 22 can cause the stand-up structure 12 to return to the position shown in FIG. 1.

It will be understood that in order to hold the handicapped subject S in the standing posture of FIG. 2, it is necessary to implement a device for holding the body and comprising first means 24 constituted by front leg pieces and second means 25 having the characteristic of being constituted in the form of angled or substantially angled arm-rests 26 suitable for occupying a position as shown in FIG. 1 where they occupy substantially vertical planes to constitute side guards for the body, or substantially horizontal planes as shown in FIG. 2 where each of them constitutes half of a chest-retainer.

The object of the invention is to make it possible to pass from the position shown in FIG. 1 to the position shown in FIG. 2 or back again while ensuring positive locking in each of the positions so as to guarantee the safety of the subject.

The invention thus relates to a hinge block 30 suitable for performing these functions, while also enabling the subject S to provide manual drive or control. Each hinge block 30 is designed to be fitted to an upright 31 of the frame of the back 16.

The block 30 comprises a back half-block 32 and an arm-rest half-block 33. The back half-block 32 is locked, fastened, or fitted to the upright 31 by means of a clamp 34 surrounding the upright 31 on which it is fastened by means of through screws 35.

In one construction, the half-block 32 is mounted by means of the clamp 34 in such a manner that the half-block 32 is directed towards the lateral outer portion of the frame of the back, as defined by arrow F, and the through screws 35 are adapted so that their heads are accessible from the face 36 of the half-block 32 situated facing a corresponding face 37 of the other half-block 33.

The half-block 32 carries a pivot pin 38 which is preferably mounted through the clamp 34, although this particular disposition is not essential. The pivot pin 38 has an end portion 38*a* projecting beyond the face 36. In a structural disposition that is good for appearance and safety, the half-block 32 is circular in shape where it faces the face 36, is fastened by the screws 35 which are in alignment on a diameter D, and carries the pivot pin 38 which is off-center rearwards relative to the diameter D and upwards relative to an orthogonal diameter d.

The face 36 of the half-block 32 has a groove 39 (FIG. 5) forming an annular segment which is concentric about the pivot pin 38 and which possesses an end 39*a* that is situated substantially on the diameter d, and an end 39*b* which is offset from the first end by an angle that is substantially equal to 90°.

The face 36 is made so as to cause the half-block 32 to include a bottom lug 40 from which there rises a stud 41 in a vertical direction and situated opposite from the pin 38 about the diameter D.

In all cases, whether the pivot pin 38 is carried solely by the half-block 32 or by the assembly comprising the half-block and the clamp 38, it extends in a substantially horizontal direction x–x' so that the end portion 38*a* thereof projects towards the outside F of the frame of the back.

Figure 6:
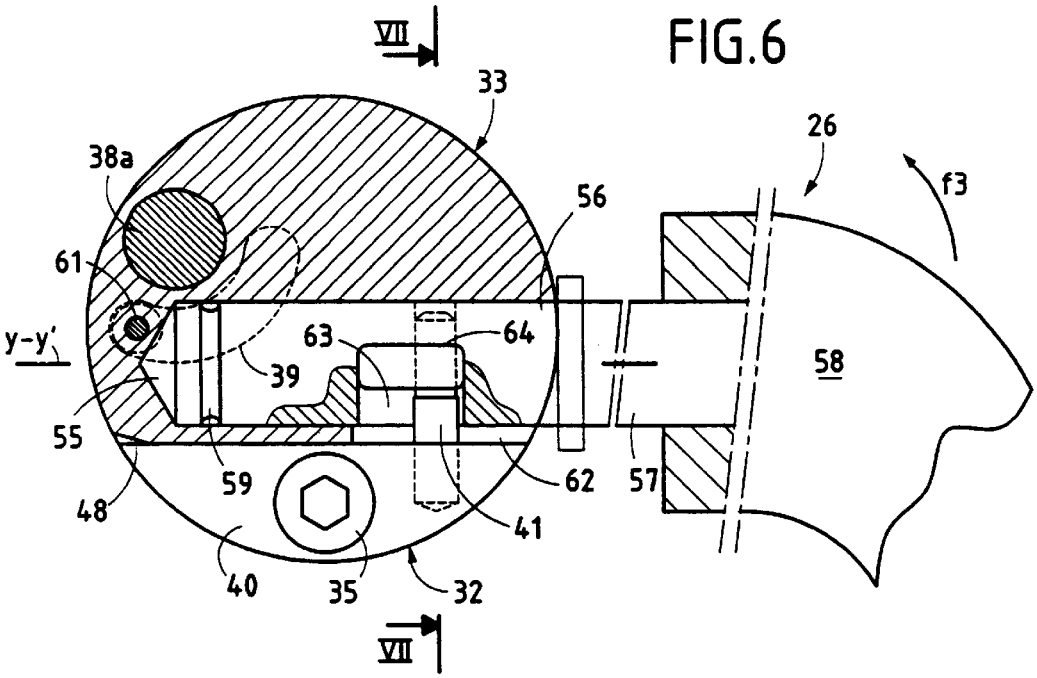
FIG. 6 is a section on line VI—VI of FIG. 3.

As can be seen more particularly in FIGS. 3, 4, and 6, the half-block of the arm-rest 33 is constituted by a body of generally cylindrical shape which has a blind hole 45 opening out from the face 37 so as to enable it to be engaged on the end portion 38*a* of the pivot pin 38. The face 37 is made in such a manner as to include a setback 46 defined by a surface 47 for covering the top 48 of the lug 40 and by a cheek 49 for covering said lug 40 in the position in which the half-block 33 is placed in an angularly stable position relative to the half-block 32 and fully overlaps it. The half-block 33 is fitted to the end portion 38a by means of a retaining pin 50 which is engaged in a hole of the half-block 33 going from the base of the cheek 49 so as to co-operate with a groove 51 present in the end portion 38*a*. This kind of assembly prevents the half-block 33 from moving axially along the pivot pin, while allowing rotation about the axis x–x'.

In a plane below the axis x–x', the arm-rest half-block 33 possesses a blind hole 55 suitable for rotatably receiving the shank 56 of an angled arm-rest frame 57 that is covered in padding 58. To this end, the blind hole 55 is formed along a substantially horizontal axis y–y' that is orthogonal to the axis of the bore 45 so that its opening faces towards the front of the wheelchair, thus enabling the arm-rest 26 to be mounted therein, as shown in FIG. 1.

The shank 56 is rotatably received in the bore 55 where it is retained axially by means of the retaining pin 50 that co-operates with a groove 59 in said shank.

The block of the invention is provided with means suitable for defining a stable angular position for the half-block 33 relative to the half-block 32, in which stable angular position the axis y–y' extends in a substantially horizontal direction. Such means may make use of co-operation whereby the face 47 presses against the top 48, as shown in FIG. 6, or co-operation between the head 60 of a finger 61 carried by the face 37 to be permanently engaged in the annular segment groove 39, in particular to co-operate with the end 39*a*.

The block also makes use of means for preventing the arm-rest 26 from moving whether it is in the position shown in FIG. 1 or in the position shown in FIG. 2, which means comprise the stud 41 which is caused to pass through a slot 62 formed in the base of the half-block 33 so as to open out into the blind hole 55.

In addition, the shank 56 has two notches or mortises 63 and 64 that are blind, opening out to the periphery of the shank and extending over a depth that is smaller than the radius of the shank, being disposed in such a manner that the stud 41 can penetrate therein in the stable angular position, depending on whether the arm-rest 26 is occupying the FIG. 1 position or the FIG. 2 position.

Figure 7:
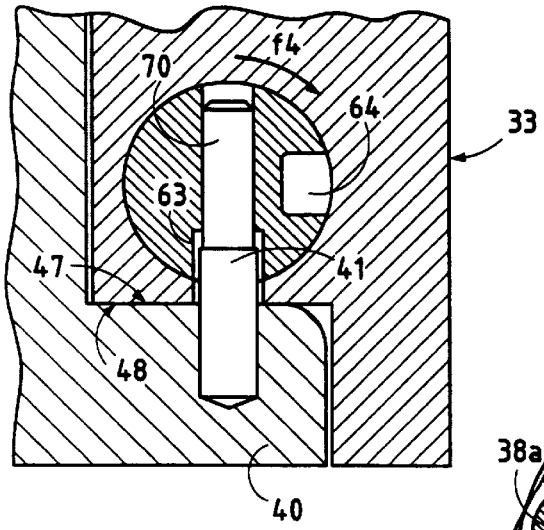
FIG. 7 is a section on line VII—VII of FIG. 6.

In the state shown in FIGS. 6 and 7, the shank 56 extends along a substantially horizontal direction defined, in the stable angular position of the half-block 33 in abutment against the locking means presented by the half-block 32, such as co-operation between the surfaces 47 and 48. In such a position, the stud 41 is engaged through the slot 42 and penetrates into the notch 63 such that the shank 56 is locked in an angular position in which the arm-rest 26 extends so as to occupy a substantially vertical plane, so as to form, as shown in FIG. 1, a guard on one side of the body of the subject S.

When it is desired to drive the articulated structure into the standing-up position, as shown in FIG. 2, the subject S acts on the arm-rest 26 in the direction of arrow $f_3$ (FIG. 6) so as to pivot it upwards, thereby causing the half-block 33 to pivot on the end portion 38*a* so as to disengage the stud 41 from the notch 63.

Figure 8:
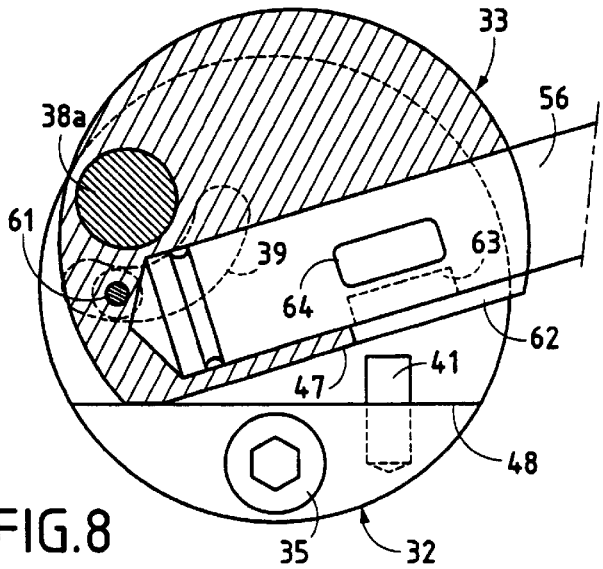
FIG. 8 is a view analogous to FIG. 6 but showing another characteristic position.

Once this position has been achieved, as shown in FIG. 8, the subject S can then cause the arm-rest 26 to pivot in the direction of arrow $f_4$ (FIG. 7) so as to bring the angled proton thereof towards the inside of the hinged structure so that the angled portion becomes substantially horizontal, as shown in FIG. 2.

By rotating the shank 56, this movement serves to bring the notch 64 over the stud 41 and consequently subsequently to lower the arm-rest 26 by moving it in the direction opposite to the arrow $f_3$ so as to pivot the half-block 33 on the end portion 38*a*. In this situation, and when the stable angular position is again reached, the arm-rest is locked angularly and constitutes, as shown in FIG. 2, half of a chest-retainer for contributing to holding the body of the subject S.

Operations performed in the reverse order to that described above serve to bring the arm-rest 26 back to its initial position.

It should be observed that the stable angular position can also be designed by using adjustment means making it possible to vary the inclination of the axis y–y' relative to the horizontal. Such means may be constituted by a screw 70 accessible from the bottom of the notch 63 so as to be capable of being controlled to project from the bottom of said notch and co-operate with the stud 41, as shown by way of example in FIGS. 6 and 7.

It should also be observed from FIGS. 6 and 8 that the groove 39 is designed to extend over an angular extent of at least 90° so that when desirable it is possible to raise the arm-rest 26 completely from the position shown in FIG. 1 and bring it close to, or set it back behind, alignment with the upright 31 in a stop position determined by the head 60 coming into contact with the end 39*b* of the groove 39.

The above-described structural details show that the block 30, once it has been installed on the upright 31, provides an outside surface in the form of a volume that is substantially cylindrical and that has no sharp edges, projecting members, or well-marked gaps that could give rise to pinching or damage. Once they have been fitted using a single retaining pin, the faces 36 and 37 are practically touching and the cheek 49 covers the lug 40. The screws 35 are thus completely masked.

In the stable angular position, the members constituting the locking means and angular adjustment means, such as 41, 57, 64, 63, and indeed 70, are also completely hidden by being housed inside the half-block 33.

The same applies to the means for providing angular control between the half-block 33 and the half-block 32 as constituted by the groove 39 and the finger 60.

Such technical means of the invention consequently make it possible to eliminate the risk of pinching the fingers, damaging clothes, or breaking cables or ducts conveying electrical power, while making it simple and easy to go from a locked position as shown in FIG. 1 to another locked position as shown in FIG. 2, and back again.

Figure 9:
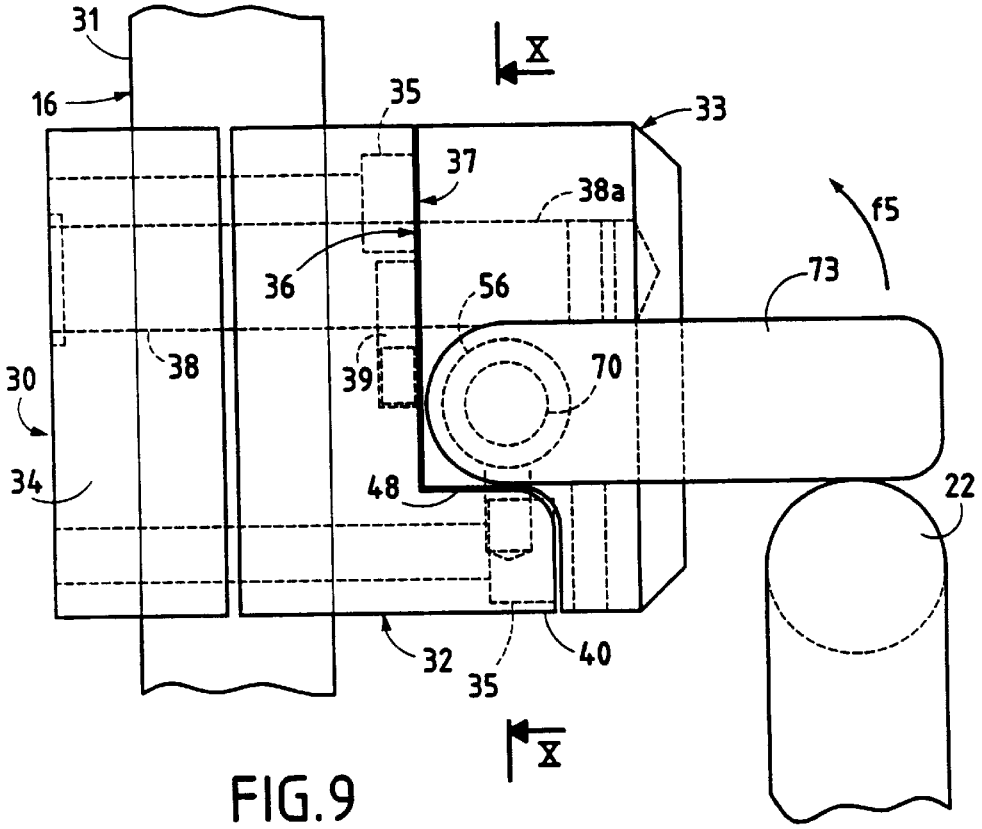
FIG. 9 is a view analogous to FIG. 3, but showing a variant.
Figure 10:
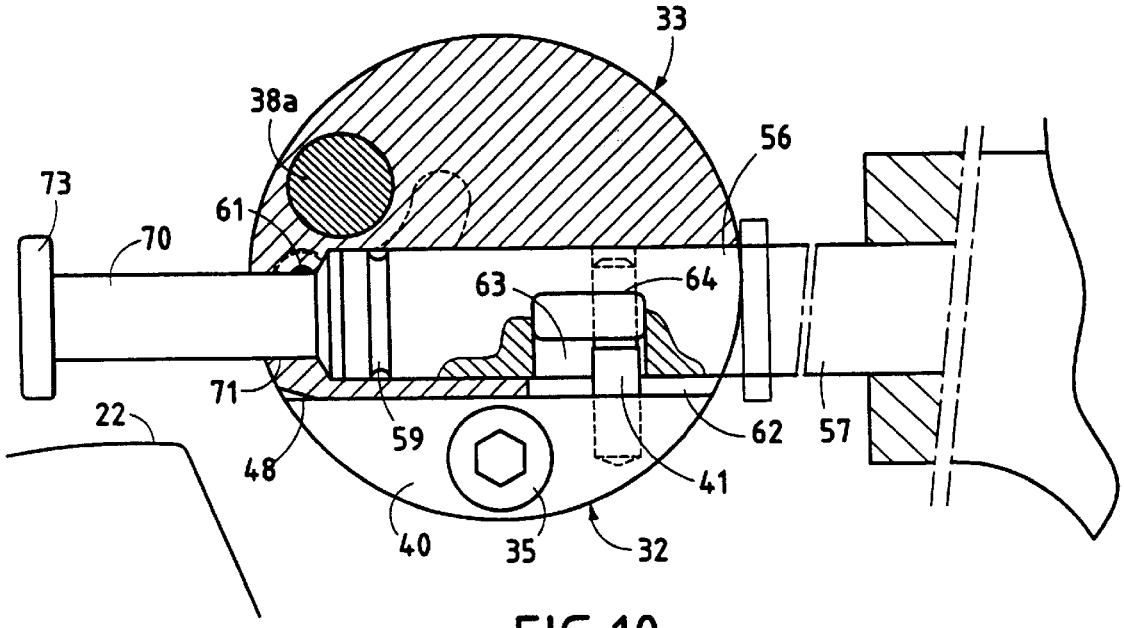
FIG. 10 is a section on line X—X of FIG. 9.

FIGS. 1, 9, and 10 show a variant embodiment for the above-described block. The purpose of this variant is to provide passive safety for the safety S preventing the subject from acting positively on the drive members 22 unless at least one of the arm-rests 26 has previously been controlled so as to take up its chest-retaining position, as described above.

To this end, and as shown in FIGS. 9 and 10, the cylindrical shank is provided, remote from the padding 58, with an extension 70 that is received in a hole 71 that is coaxial with the bore 55, thereby extending the block 30 outwards towards the rear portion of the seat, in a plane superposed relative to the drive member 22, as shown in FIG. 1.

The extension 70 carries a bar 73 which, in the substantially vertical position of the arm-rest 56, extends outwards substantially horizontally and directly over the member 22.

In such a position, it will be understood that action in the direction of arrow $f_1$ is prevented because of the abutment constituted by the bar 73. To make it possible to move the structure 12 into a stand-up position, the subject S must therefore act initially, as mentioned above, on the arm-rest 26 so as to pivot it upwards and release the notch 63, thereby making rotation in the direction of arrow $f_5$ (FIG. 9) possible through about three-fourths of a revolution, so as to bring the notch into a position where it can co-operate with the stud 41. By performing this movement in the opposite direction to that described above, the bar 73 is retracted relative to the member 22 which can then be subjected to drive in the direction of arrow $f_1$.

The invention is not limited to the examples described and shown, and various modifications can be made thereto without going beyond the ambit of the invention.

What is claimed is:

1. A hinge block for angled arm-rests for a wheelchair for the handicapped, the wheelchair including a stand-up articulated structure having an upright back, the arm-rest being designed to be placed either in a generally vertical position wherein the arm-rest provides a side guard for the body of a subject occupying the wheel chair in a sitting position, or in a generally horizontal position wherein the arm-rest constitutes half of a chest-retainer for said subject when in a standing position, the hinge block comprising:

a back half-block adapted to be fastened to the upright back and having a substantially horizontal pivot axis;

an arm-rest half-block mounted to pivot on the pivot axis from a stable angular position and defining a substantially horizontal bore orthogonal to the pivot axis, and rotatably receiving a cylindrical shank of an angled arm-rest; and means interposed between the two half-blocks to ensure: that the shank is locked when the angled arm-rest is occupying either a position that is substantially vertical or a position that is substantially horizontal; and that partial pivoting of the arm-rest half-block about the pivot axis unlocks said locking means to allow said cylindrical shank to rotate and to be locked angularly after said cylindrical shank has rotated.

2. A hinge block according to claim 1, wherein the means interposed between the two half-blocks comprise, for angularly locking the cylindrical shank in the bore:

firstly on said cylindrical shank two blind notches or mortises formed from a periphery of said cylindrical shank to a depth of less than the radius of the cylindrical shank, and separated from each other by an angle of about 90°;

secondly, in the arm-rest half-block, a slot having the same length as the notches and formed so that each of the notches can be placed in register with said slot; and also a stud carried by the back half-block to pass through the slot and penetrate into one or other of the notches in the stable angular position of the arm-rest half-block relative to the back half-block.

3. A hinge block according to claim 1, wherein the stable angular position is defined by the arm-rest half-block bearing against the back half-block.

4. A hinge block according to claim 1, wherein the stable angular position is defined by an adjustable screw capable of projecting from the bottom of the notch determining the substantially vertical plane position of the arm-rest, to co-operate with the stud.

5. A hinge block according to claim 1, wherein the means interposed between the half-blocks comprise, to enable the arm-rest half-block to pivot on the pivot pin:

firstly a groove forming a segment of a ring and formed in the back half-block concentrically about the pivot pin and extending over an angular range of not less than 90°; and secondly an abutment finger carried by the arm-rest half-block to penetrate into the groove.

6. A hinge block according to claim 5, wherein the groove is formed in the back half-block face facing an arm-rest half-block face carrying the finger.

7. A hinge block according to claim 1, wherein said locking means is a clamp connected by two lock screws accessible from said arm-rest half-block face.

8. A hinge block according to claim 1, wherein the back half-block includes a face, a lug extending from said face and a stud extending from said face above said lug, wherein the arm-rest half-block presents a setback in back half-block face for receiving the lug and leaving a cheek to cover said lug.

9. A hinge block according to claim 8, wherein the setback defines a face covering the top of the lug and in which a slot for passing said stud is formed.

10. A hinge block according to claim 1, wherein the arm-rest half-block is locked axially but free to pivot angularly on the pivot pin by a retaining pin also axially retaining said cylindrical shank of the arm-rest, said shank being rotatably received in the bore.

11. A hinge block according to claim 1, wherein said cylindrical shank is provided, opposite from the arm-rest, with an extension extending beyond the block and including, outside the block, a bar extending over the drive member so as to constitute a stop when the arm-rest is in its position where it constitutes a side guard for the body, occupying a plane that is substantially vertical.

12. A wheelchair for the handicapped including a stand-up structure in which two uprights of the back are provided with respective arm-rests, each connected to the corresponding upright via a hinge block according to claim 1.

* * * * *